US005333991A

United States Patent [19]

Kato

[11] Patent Number: 5,333,991

[45] Date of Patent: Aug. 2, 1994

[54] THERMAL FATIGUE PREVENTION APPARATUS FOR HIGH TEMPERATURE PUMP

[75] Inventor: Hiroyuki Kato, Yokohama, Japan

[73] Assignees: Ebara Corporation; The Tokyo Electric Power Company Inc., both of Tokyo; Tohoku Electric Power Company Inc., Sendai; Chubu Electric Power Company Inc., Nagoya; Hokuriku Electric Power Company, Toyama; Chugoku Electric Power Company, Inc., Hiroshima; The Japan Atomic Power Company, Tokyo; Kabushiki Kaisha Toshiba, Kawasaki; Hitachi Ltd., Tokyo, all of Japan

[21] Appl. No.: 51,294

[22] Filed: Apr. 23, 1993

Related U.S. Application Data

[63] Continuation of Ser. No. 782,175, Oct. 24, 1991, abandoned.

[30] Foreign Application Priority Data

Oct. 26, 1990 [JP] Japan ..... 2-287286

[51] Int. Cl.[5] ..... F04D 29/58

[52] U.S. Cl. ..... 415/112; 415/176; 415/178

[58] Field of Search ..... 415/110, 111, 112, 116, 415/175, 176, 177, 178, 180

[56] References Cited

U.S. PATENT DOCUMENTS 4,005,747 2/1977 Ball ..... 415/112
4,775,293 10/1988 Boster ..... 415/112
4,932,836 6/1990 Boster .
5,143,515 9/1992 Boster et al. .

FOREIGN PATENT DOCUMENTS 0111024 6/1984 European Pat. Off. .
57-50692 3/1982 Japan .
59-229092 12/1984 Japan .
64-4160 1/1989 Japan .
1-178792 7/1989 Japan .

OTHER PUBLICATIONS

Patent Abstracts of Japan, vol. 6, No. 150 (M-148) (1028), Aug. 10, 1982 & JP-A-57 068 585, Apr. 26, 1982.

Patent Abstracts of Japan, vol. 6, No. 150 (M-148) (1028), Aug. 10, 1982 & JP-A-57 068 584, Apr. 26, 1982.

*Primary Examiner*—Edward K. Look
*Assistant Examiner*—James A. Larson
*Attorney, Agent, or Firm*—Nikaido, Marmelstein, Murray & Oram

[57] ABSTRACT

A thermal fatigue prevention apparatus for a high temperature pump which includes an impeller in a high temperature pump casing, a pump shaft rotatably supported by a journal of a submerged bearing and projecting from a shaft through hole of a casing cover, and a shaft sealing device. The shaft sealing device is enclosed with a shaft sealing chamber which is supplied with a low temperature seal purging liquid, and a part of the seal purging liquid flows into the pump casing through the shaft through hole. A heater is provided within the high temperature pump, the heater raises the temperature of the low temperature seal purging liquid before the seal purging liquid flows into the pump casing by using the high temperature pumping liquid.

3 Claims, 11 Drawing Sheets

THERMAL FATIGUE PREVENTION APPARATUS FOR HIGH TEMPERATURE PUMP

This application is a continuation of application Ser. No. 07/782,175 filed Oct. 24, 1991 abandoned.

BACKGROUND OF THE INVENTION

The present invention relates to a thermal fatigue prevention apparatus for a high temperature pump such as a reactor coolant recirculation pump for treating a high temperature pumping liquid, and more particularly to a thermal fatigue prevention apparatus in which a low temperature seal purging liquid is supplied into a shaft sealing chamber for cooling and cleaning a shaft sealing mechanism, and in which a part of the seal purging liquid is caused to flow into a high temperature pump casing through a pump shaft through hole.

In the region of a shaft through hole 12 formed between a pump casing 1 and a pump shaft 4 of a pumping system as shown in FIG. 12 by way of example, there is commonly provided a shaft sealing mechanism such as a mechanical seal 14. Through the shaft through hole 12, a seal purge liquid A having a suitable temperature (usually of the order of ordinary temperature) is led into a shaft sealing chamber 6*a* from the outside for the purpose of cooling and cleaning the shaft sealing mechanism 14.

In this case, when a pumping liquid B is of a high temperature, there arises a great temperature difference between the inside of the shaft sealing chamber 6*a* which is kept at a low temperature due to the seal purging liquid A, and the inside of the casing 1 through which the pumping liquid B circulates. Such a temperature interface appears in a region C where the low temperature seal purging liquid A flowing into the pump casing 1 from the shaft sealing chamber 6*a* through a casing cover 2 is mixed with the high temperature pumping liquid, which causes a dramatic temperature fluctuation phenomenon during the irreversible mixing process of a low temperature liquid and a high temperature liquid. As a result, a fluctuating thermal stress is generated within the adjacent metallic structure, which may bring about cracks in the metal.

Conventionally to cope with such problem, sleeves 15*a* and 15*b*, which can be replaced with new ones whenever thermal fatigue occurs, are arranged on the metallic part in the mixture region C of liquids A and B as shown in FIG. 13. However, this replacement work is troublesome because a main bolt 13 must be removed (FIG. 15). Also, in order to check for the occurrence of the thermal fatigue, there is a need for a disassembling check which is extremely troublesome in the reactor coolant recirculation pump because of the possible presence of radiation.

Furthermore, Japanese Examined Patent Publication (Kokoku) No. 64-4160 discloses a thermal barrier 16 arranged within a journal 11 (FIG. 15) of the submerged bearing 10 as shown in FIG. 14, thereby raising the temperature of the seal purging liquid A to consequently reduce the temperature difference between the seal purging liquid A and the pumping liquid B. However, in this known technique it is substantially impossible to obtain an adequate temperature rise effect by means of a thermal barrier 16, which leads to a difficulty in preventing thermal fatigue.

FIG. 15 shows a reactor coolant recirculation pump, that is, a representative pump treating a high temperature water, to which the present invention is applied. In the drawing, within a pump casing 1, an impeller 3 is rotatably supported by a journal 11 of a submerged bearing 10. A pump shaft 4 of the impeller 3 projects from a shaft through hole 12 of a casing cover 2, and is drivingly connected to a motor (not shown) through a coupling 7 within a motor pedestal 8 mounted on the casing 1 by means of main bolts 13. Between the pump shaft 4 and the casing cover 2, there is provided a shaft sealing device 6 including a mechanical seal 14. This shaft sealing device 6 is provided with a shaft sealing chamber cooler 5 which is in turn equipped with a seal purging liquid supply inlet 5*a*. Besides, reference numeral 9 in the drawing denotes an impeller for circulating the seal purging liquid.

In this pump, a low temperature (e.g., about 40° C.) seal purging liquid A of, for example, 5 liter/minute is supplied into a shaft sealing chamber 6*a* (FIG. 12) of the shaft sealing device 6. Among the liquid A, about 3 liter/minute, for example, of seal purging liquid is discharged through a mechanical seal 14 to the outside of the pump. Therefore, a remainder of about 2 liter/minute is permitted to flow into the pump casing 1 through an annular gap of the shaft through hole 12 formed between the casing cover 2 and the pump shaft 4. As the temperature of the pumping liquid B inside the pump casing 1 is usually about 280° C., the temperature difference $\Delta T$ becomes $280-40=240$(°C.). Thus, a temperature fluctuation corresponding to temperature difference $\Delta T$ is generated in the vicinity of the outlet of the shaft through hole 12. The maximum thermal stress $\Delta\sigma$ produced on the metal surface due to the temperature fluctuation is expressed as:

$$\Delta\sigma = E\beta\Delta T\eta/(1-\nu)$$

where temperature fluctuation on metallic material surface/water temperature fluctuation $<1$ E: Elastic modulus of material $\beta$: coefficient of linear expansion of material $\nu$: Poisson's ratio of material When the material is made of austenitic stainless steel, an allowable fluctuation stress based on a fatigue limit of the material is $\Delta\sigma/2 \leqq 9$ kg/mm$^2$ (one sided amplitude), and hence it is estimated that the allowable water temperature fluctuation amount $\Delta T_{max}$ is 100° C. at most. In other words, previous to mixing with the high temperature pumping liquid B, the temperature of the low temperature seal purging liquid A must be raised so as to present a temperature difference of 100° C. or less. In the case of the above pump, there is required a heater capable of raising the temperature of about 2 liter/minute of the seal purging liquid A of 40° C., up to 180° C. ($=280-100$) or more. The above-mentioned structure employing the thermal barrier 16 and the like is insufficient, and may require an additional heater.

It is an object of the present invention to provide a thermal fatigue prevention apparatus for a high temperature pump having a simple structure and high reliability and being capable of raising the temperature of the seal purging liquid up to the appropriate temperature to prevent thermal fatigue.

SUMMARY OF THE INVENTION

According to the present invention, in a high temperature pump where a low temperature seal purging liquid is supplied into the shaft sealing chamber for the purpose of cooling and cleaning a shaft sealing device, and a part of the seal purging liquid flows through a pump shaft through hole into a high temperature pump casing, a heater for raising the temperature of the low temperature seal purging liquid by using the high temperature pumping liquid as a heat source is provided within the high temperature pump.

It is desirable that a static differential pressure or a dynamic differential pressure utilizing the rotational force of the impeller be used for circulating the pumping liquid of the heater.

It is also preferable that the passage for the pumping liquid of the heater be composed of readily processible bores having high strength.

Moreover, in order to increase the heating surface area of the heater, it is desired that the inner and outer peripheries of the heater be covered with a rotational baffle rotating together with the pump shaft, to form double seal purging passages.

In the thus configured thermal fatigue prevention apparatus, the low temperature seal purging liquid is compulsorily raised in temperature by the pumping liquid flowing within the heater, and then flows into the pump casing. Accordingly, the temperature difference between the seal purging liquid and the pumping liquid in the mixture part mixing the two liquids substantially disappears, to thereby prevent the occurrence of thermal fatigue caused by the temperature fluctuation.

BRIEF DESCRIPTION OF THE DRAWINGS

FIGS. 1 to 3 show a first embodiment of the present invention, in which

FIG. 1 is a sectional side elevation,

FIG. 2 is an enlarged view of the principal part in FIG. 1, and

FIG. 3 is a sectional view taken along a line I—I in FIG. 1;

DETAILED DESCRIPTION OF THE PREFERRED EMBODIMENTS

Embodiments of the present invention will now be described with reference to the accompanying drawings.

Figure 15:
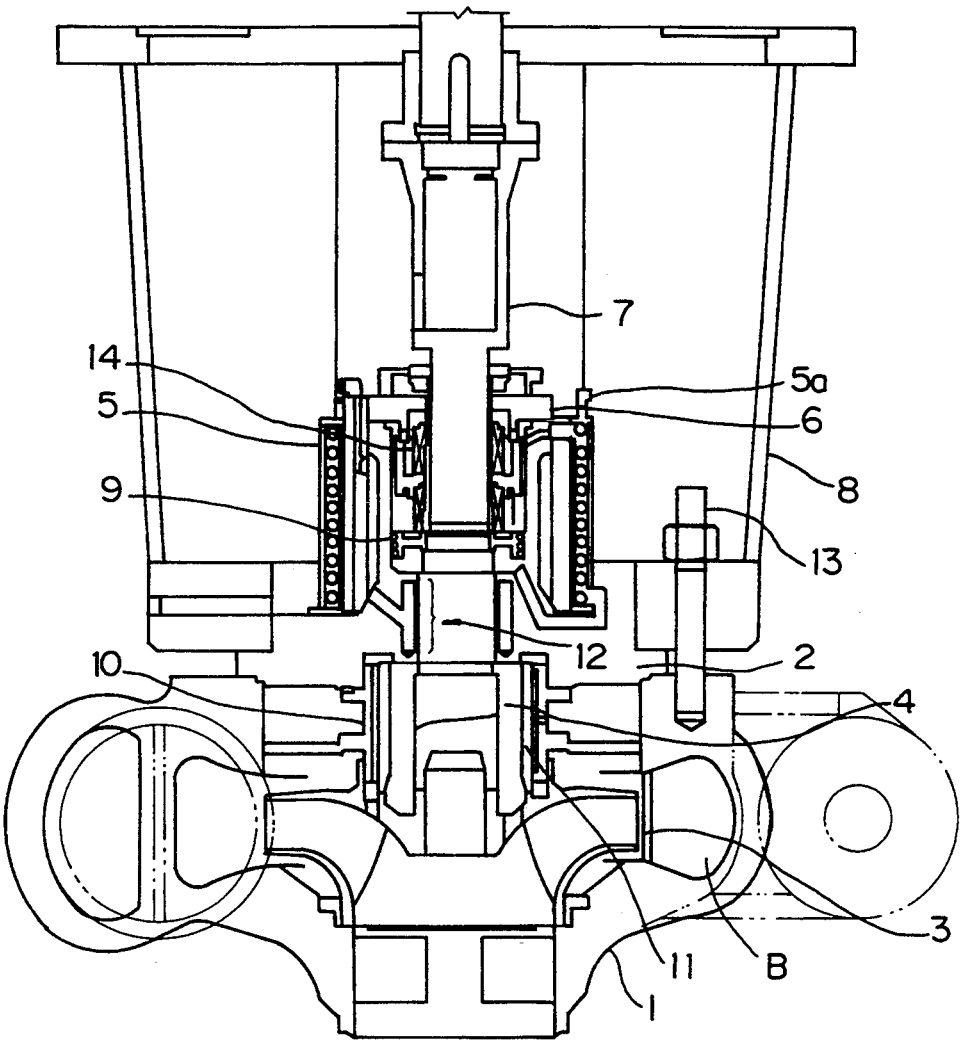
Fig. 15 PRIOR ART
FIG. 15 is a sectional side elevation showing a reactor coolant recirculation pump to which the present invention is applicable.

In these drawings, elements substantially corresponding to those in FIG. 15 are correspondingly identified by the same reference numerals to avoid repetition of an identical description.

Figure 1:
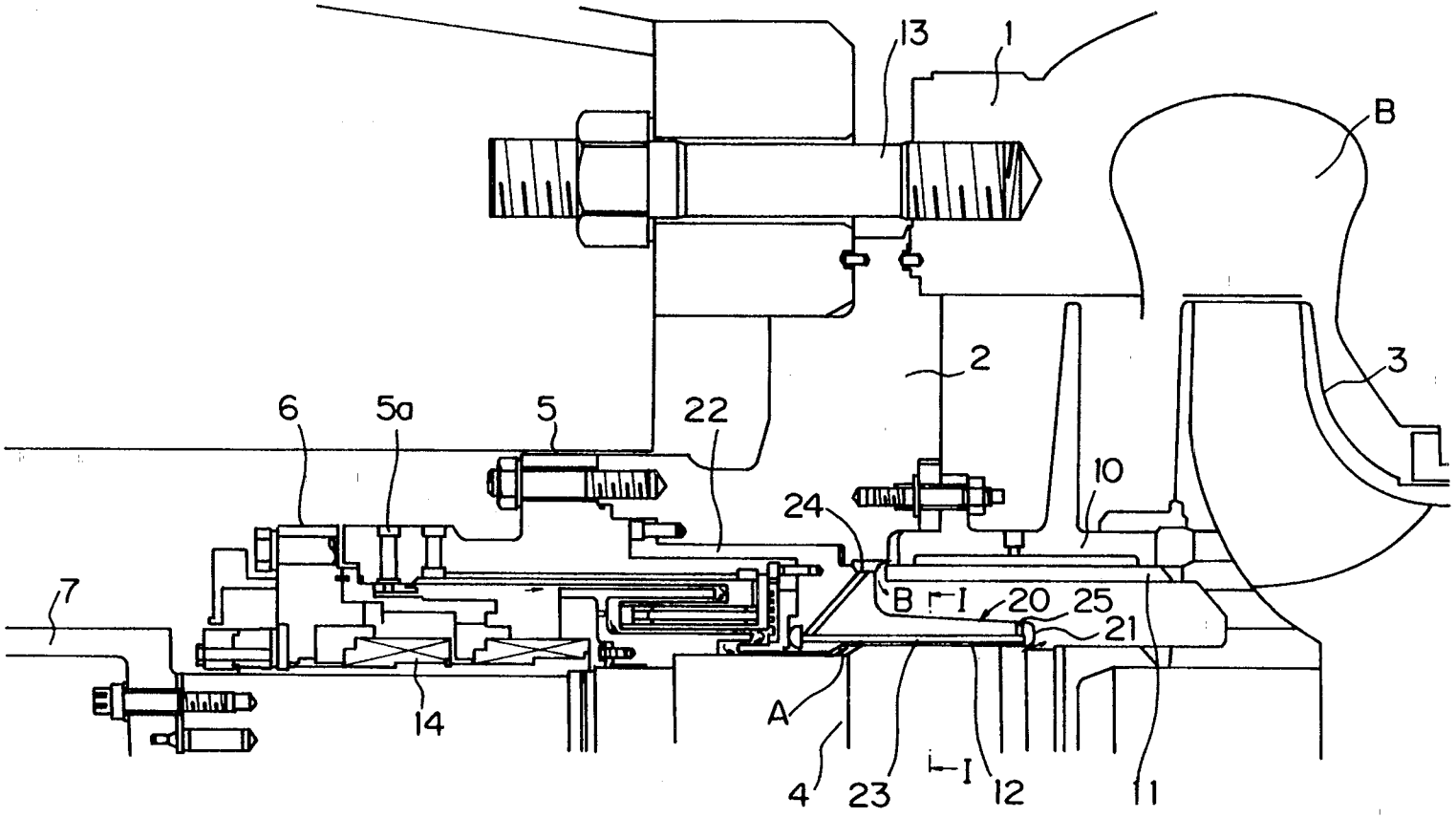
Figure 2:
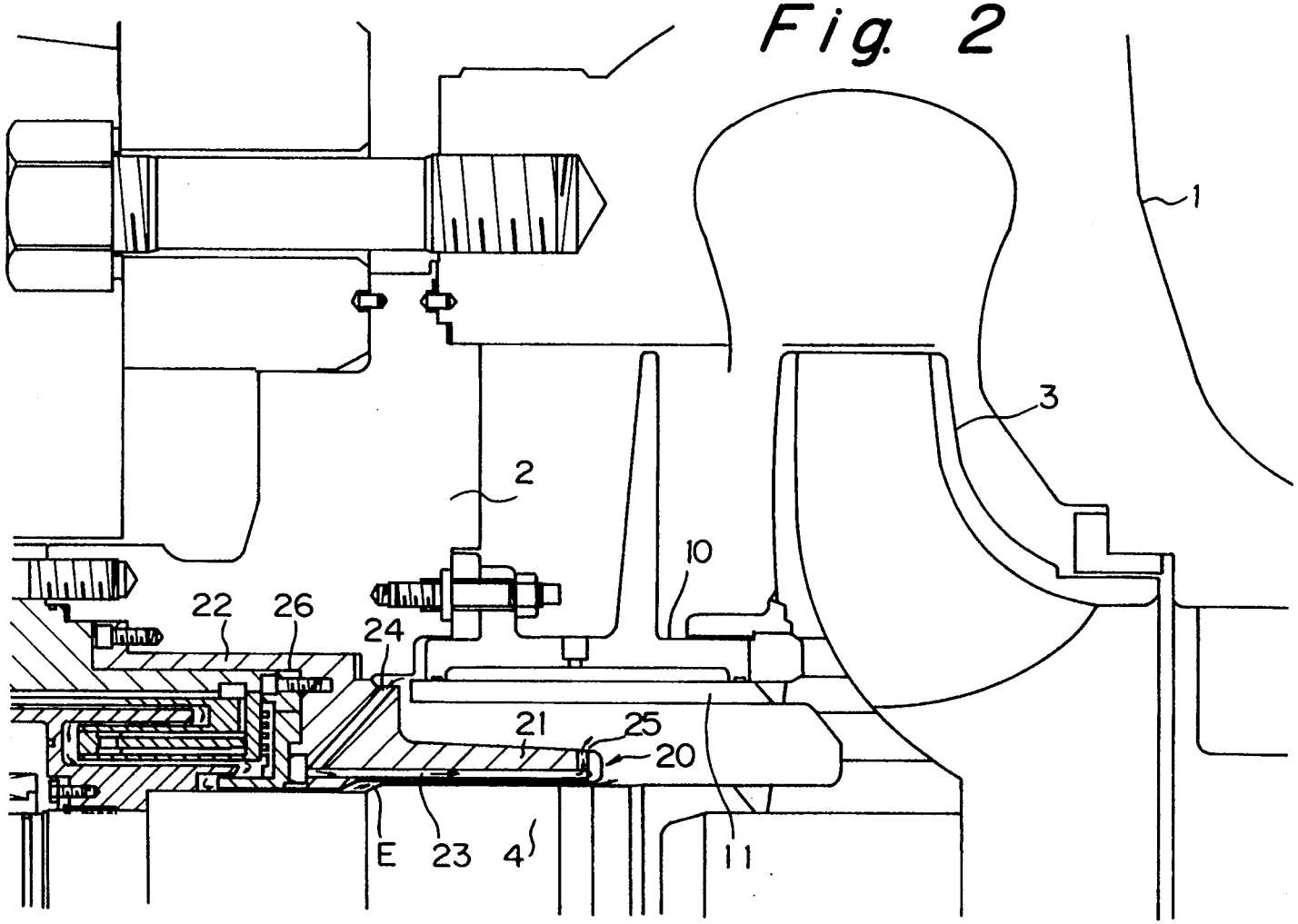
Figure 3:
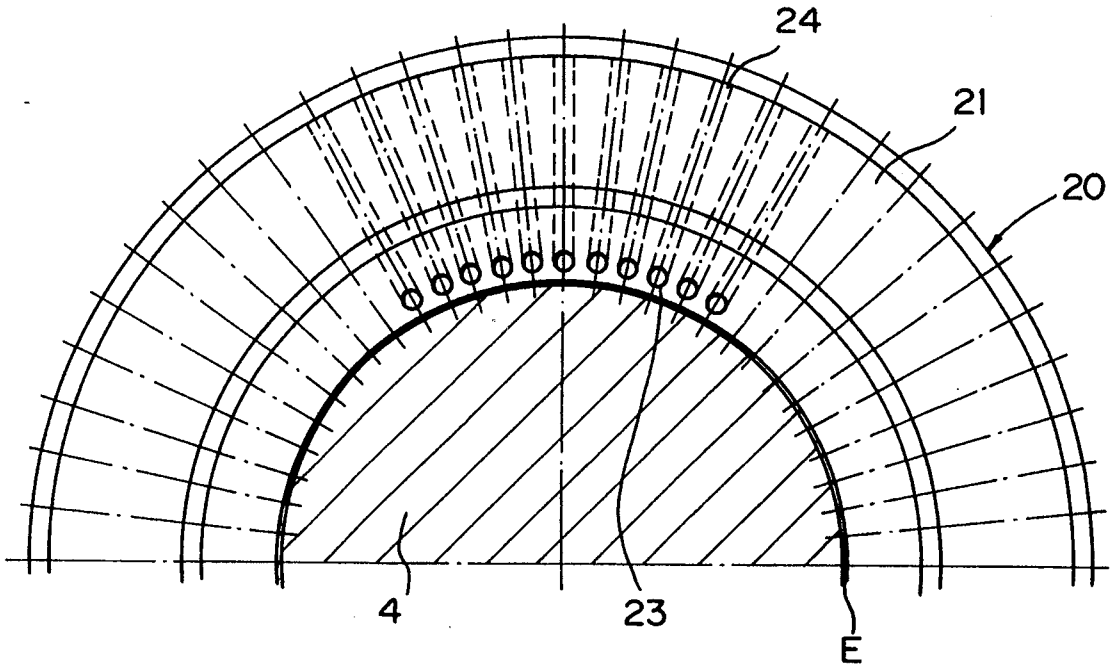

In FIGS. 1 to 3, a heater generally designated by reference numeral 20 comprises a cylindrical body 21 covering a part through which seal purging liquid A flows down, and a barrel 22 for mounting the body 21 to a casing cover 2. The body 21 is provided with an axially extending passage 23 composed of a multiplicity of bores. The passage 23 has a hot water inlet 24 provided in the vicinity of an outlet for circulating water or high temperature pumping liquid B formed on a submerged bearing 10 of a pump shaft 4, and a hot water outlet 25 provided beneath and radially inward of the hot water inlet 24. Besides, reference numeral 26 in the drawings denotes a thermal shielding plate.

Figure 4:
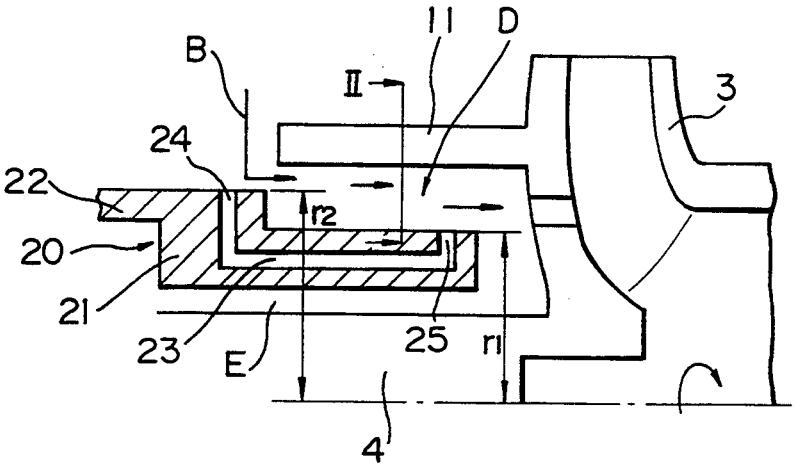
FIG. 4 is a sectional side elevation of the principal part for illustrating the static differential pressure.
Figure 5:
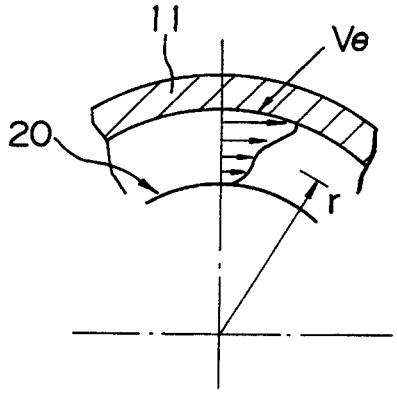
FIG. 5 is a rectangular sectional view of FIG. 4.

Therefore, as shown in FIGS. 4 and 5, a seal purging flow passage D confined by the heater 20 and a journal 11 is invariably filled with high temperature pumping liquid B, and the fluid within the space D has a peripheral velocity component $v\theta$ under the action of the journal 11 rotating in cooperation with an impeller 3. Due to this peripheral velocity component $v\theta$, there arises a radial static differential pressure $\Delta Ps$ inside the fluid based on the following expression.

$$\Delta Ps = \rho \int_{r_1}^{r_2} \frac{v\theta^2}{r}\, dr$$

where $r_1$: inner diameter of body 21

$r_2$: inner diameter of shoulder of barrel 22

$\rho$: fluid density

Accordingly, the pumping liquid B is allowed to circulate through the passage 23 owing to this differential pressure $\Delta Ps$. The passage 23 has a heating surface area sufficient to raise the low temperature seal purging liquid A up to the desired temperature.

The low temperature seal purging liquid A is thus heat-exchanged with the pumping liquid B for temperature rise during the flow down through a gap E formed between the body 21 of the heater 20 and the pump shaft 4.

Figure 6:
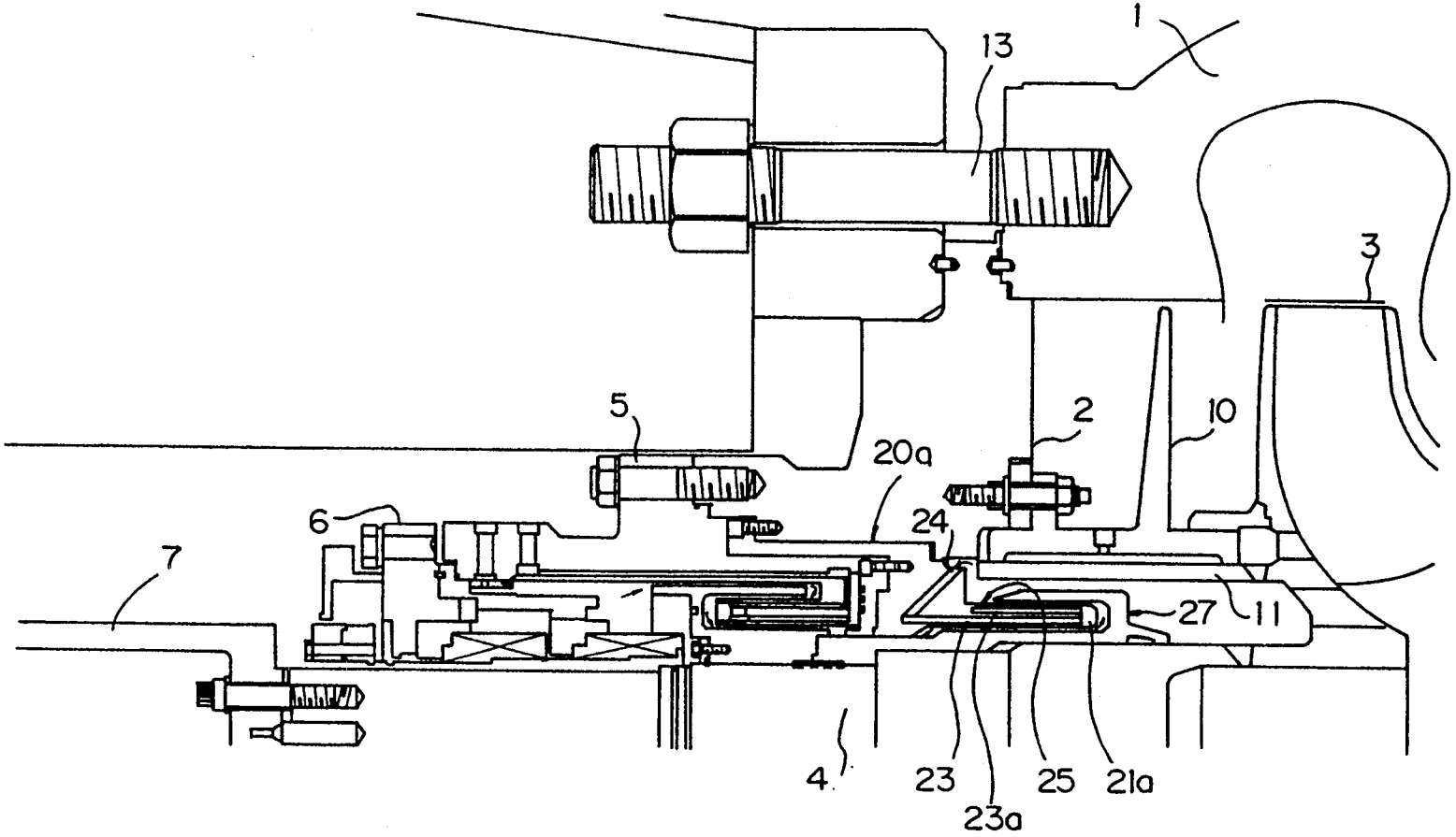
FIGS. 6 and 7 are diagram showing a second embodiment of the present invention, corresponding to FIG. 1 and FIG. 2, respectively.
Figure 7:
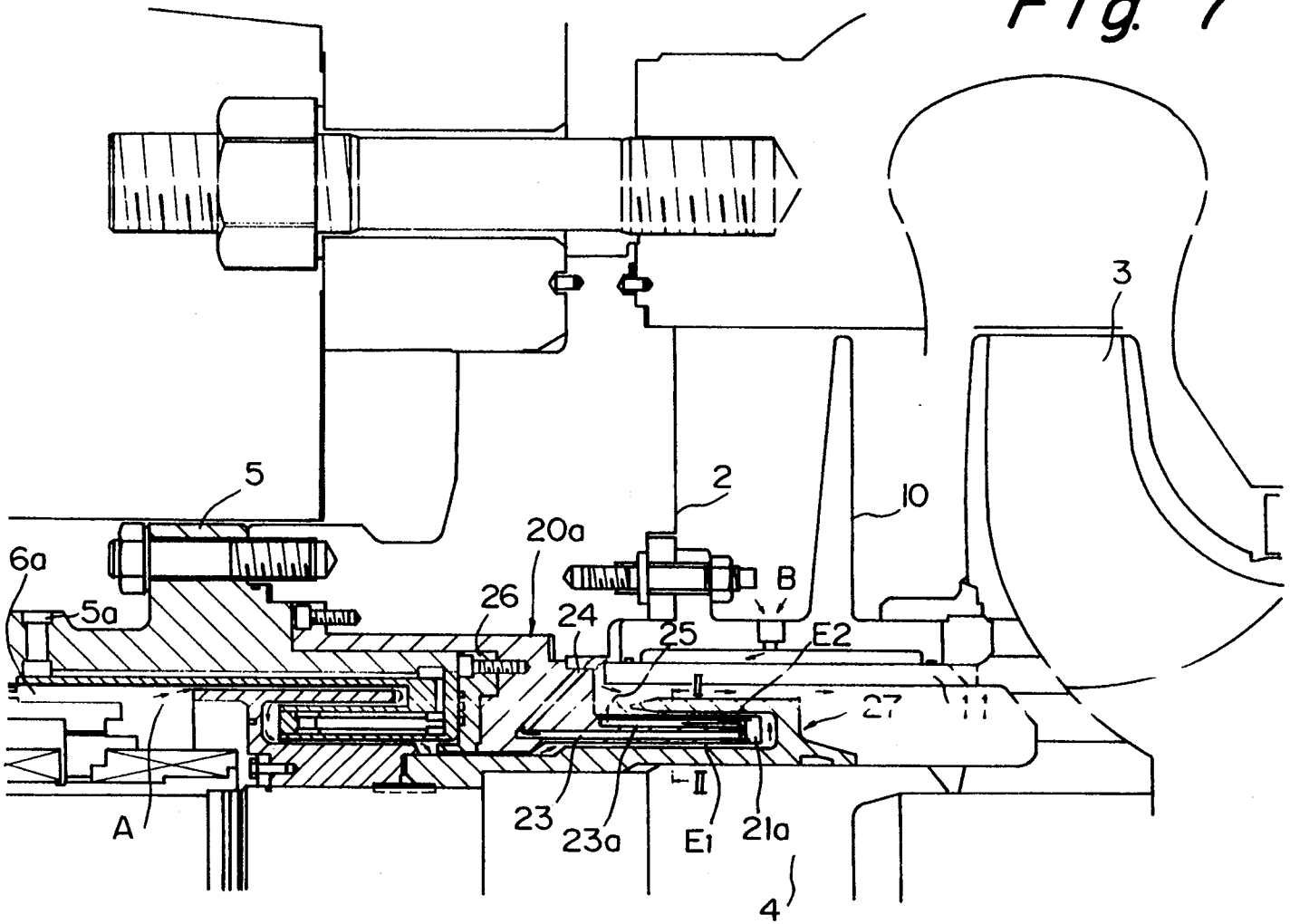
Figure 8:
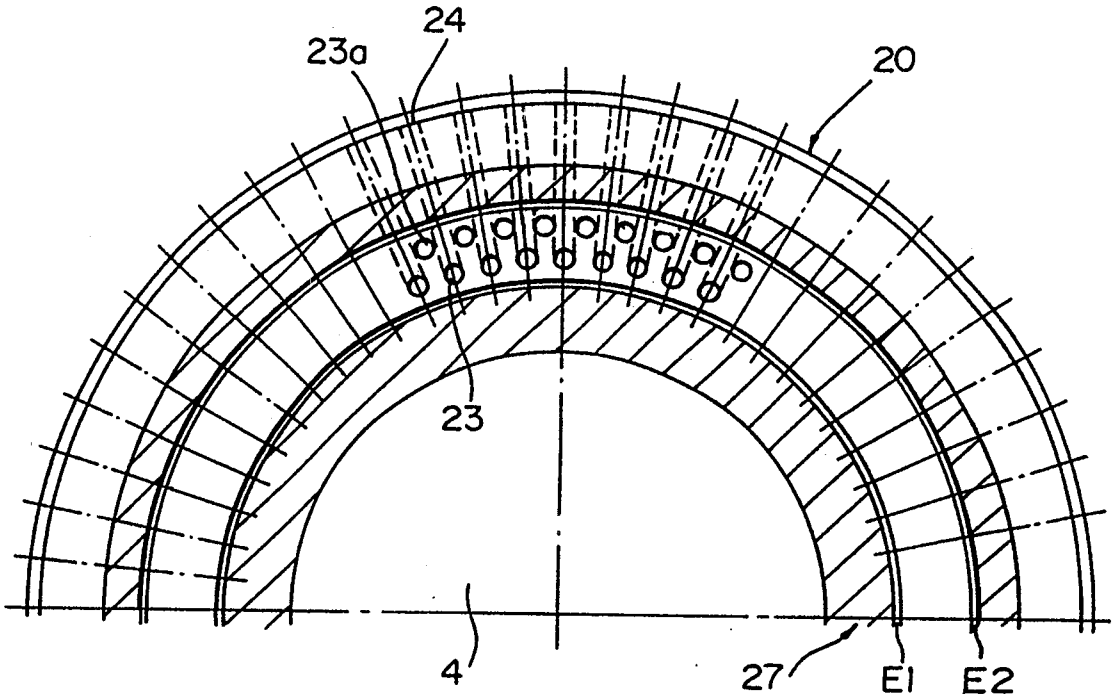
FIG. 8 is a sectional view taken along a line II—II in FIG. 7.

FIGS. 6 to 8 show another embodiment of the present invention, in which a heater **20*a* includes double passage 23 and 23*a*, a rotational baffle 27 fixedly attached to the pump shaft 4 and for covering the internal and external peripheries of a body 21*a* of the heater 20*a*, and double seal purging passages E1 and E2 formed between the body 21*a* and the baffle 27. In accordance with this embodiment, the heating surface area is increased to improve the function of the heater 20*a***.

Figure 9:
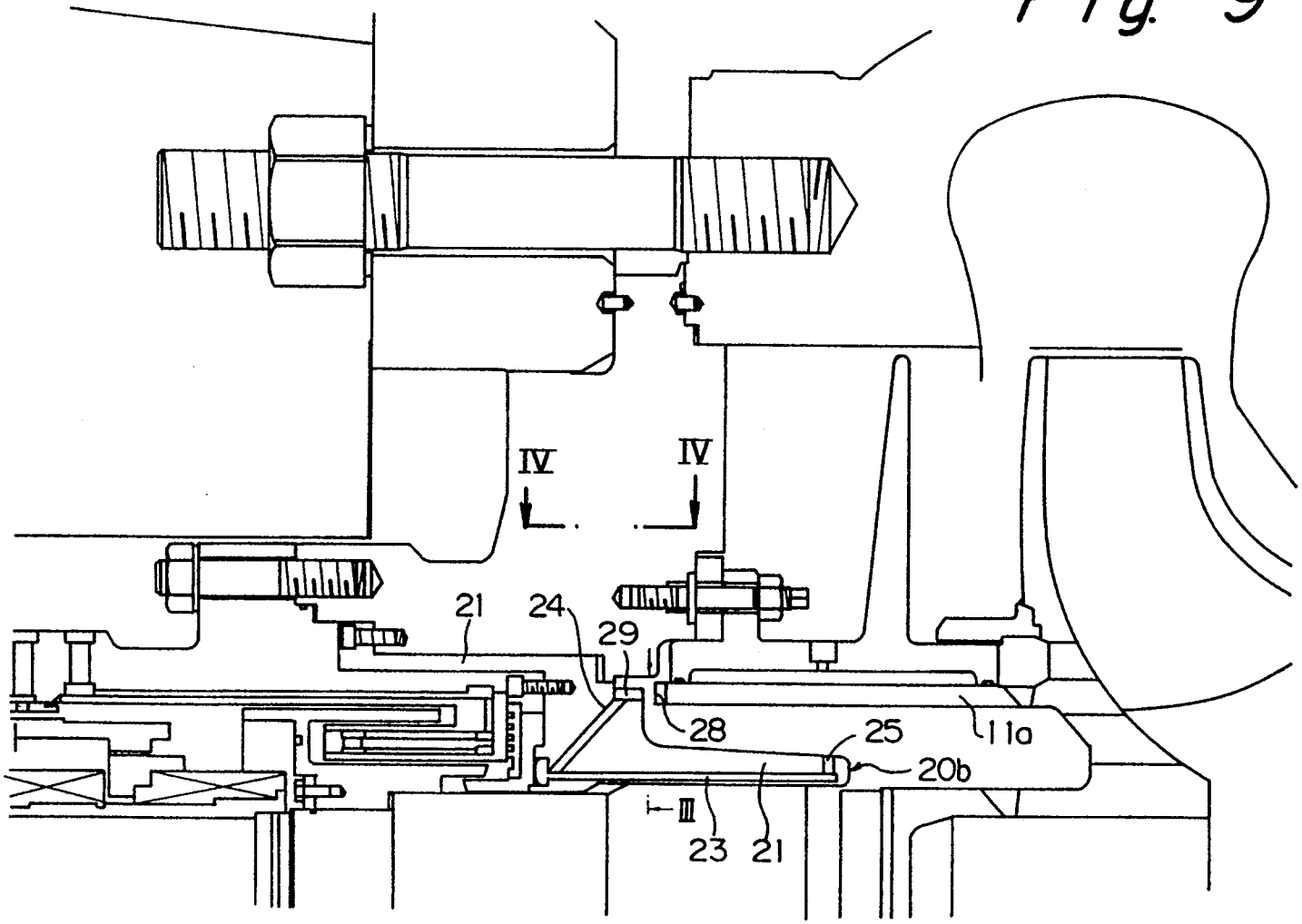
FIG. 9 is a diagram showing a third embodiment of the present invention, which corresponds to FIG. 2.
Figure 10:
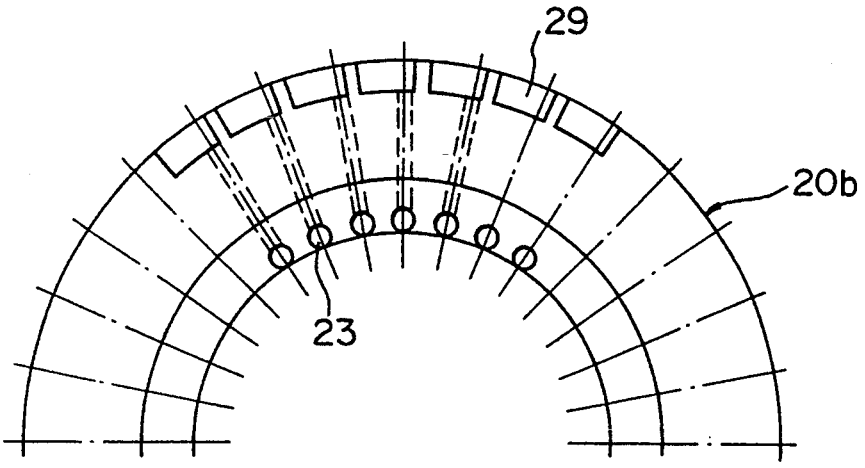
FIGS. 10 and 11 are a sectional view taken along a line III—III and a development along a line IV—IV in FIG. 9, respectively.
Figure 11:
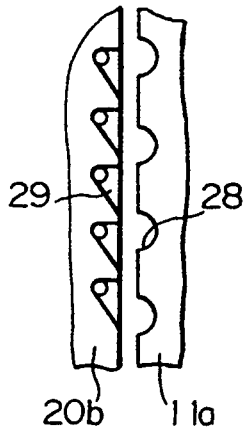
Figure 12:
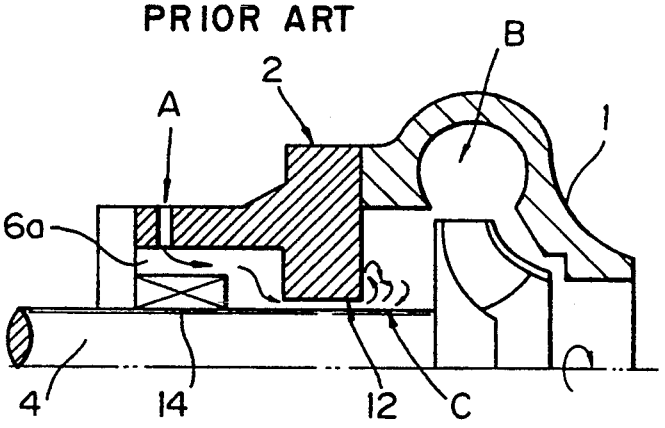
Fig. 12 PRIOR ART
FIG. 12 is a sectional side elevation for illustrating the shaft sealing chamber of the conventional pumping system.
Figure 13:
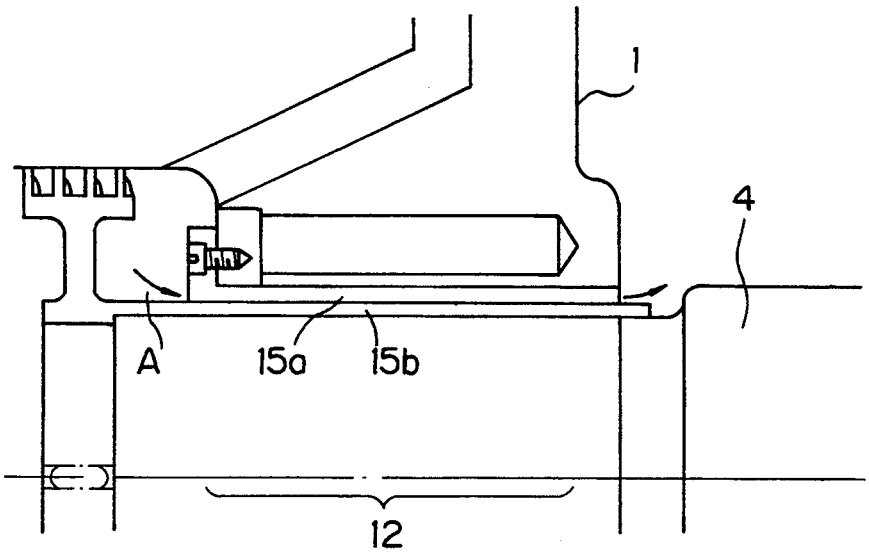
Fig. 13 PRIOR ART
FIGS. 13 and 14 are a sectional side elevation each showing a different thermal fatigue prevention apparatus.
Figure 14:
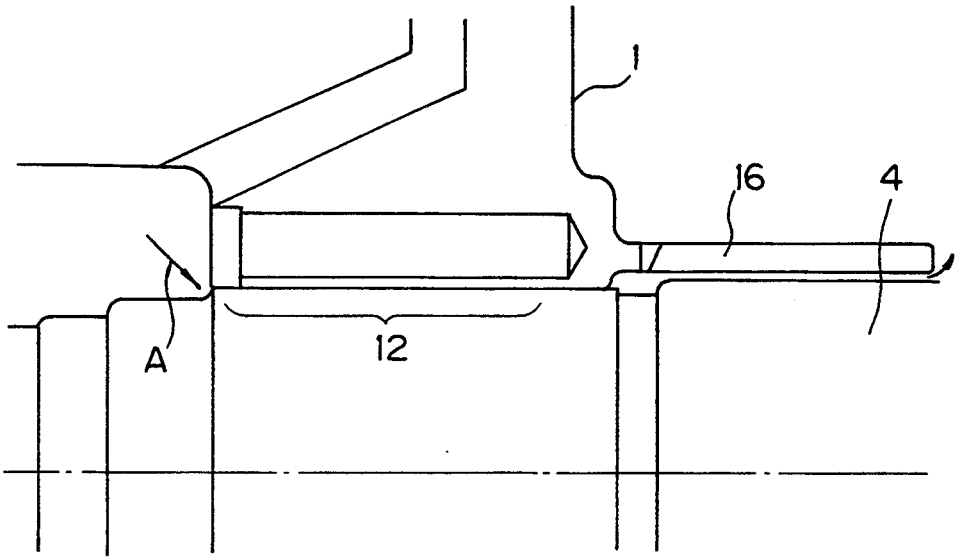
Fig. 14 PRIOR ART

FIGS. 9 to 11 show a further embodiment of the present invention, in which dynamic pressure caused by rotational force of a journal **11*a* is used as the differential pressure for hot water circulation within a heater 20*b*. That is, on the end of the journal 11*a* there are formed a multiplicity of semi-circular notches 28 for enhancing a turning force of the fluid, while in the region of the hot water inlet 24 of a heater 20*b* is wedge-shaped notch 29** for damming the tuning hot water. In this case, a damming pressure $\Delta Pd$ is expressed as $$\Delta Pd = KpU^2/2$$

where

U=tangential velocity of journal **11*a*** k=coefficient (<1)

$\rho$=fluid density

The resultant damming pressure $\Delta Pd$ is commonly larger than the above-mentioned static differential pressure $\Delta Ps$, thus leading to an improvement in the heat-exchange property in this embodiment.

In the present invention configured as described above, the temperature of the seal purging liquid is raised with the aid of a heater, thereby making it possible to prevent the occurrence of thermal fatigue which would otherwise arise from the temperature variation in the mixture part wherein the seal purging liquid is mixed with the pumping liquid.

Consequently, there is no need for disassembly to check for the occurrence of thermal fatigue, and hence the reliability of the pump can be improved.

What is claimed is:

1. A thermal fatigue prevention apparatus for a high temperature pump, comprising:

an impeller in a high temperature pump casing, a pump shaft rotatably supported by a journal of a submerged bearing and projecting from a shaft through hole of a casing cover, a shaft sealing means provided between the pump shaft and the casing cover, said shaft sealing means being enclosed with a shaft sealing chamber which is supplied with a low temperature seal purging liquid for cooling and cleaning said shaft sealing means, said seal purging liquid flowing into said pump casing through said shaft through hole, and;

a heater provided within said high temperature pump, said heater raising the temperature of the low temperature seal purging liquid before said seal purging liquid flows into said pump casing by using a high temperature pumping liquid, said heater comprising a cylindrical body around said pump shaft, said seal purging liquid flowing through a cylindrical space formed between said pump shaft and said cylindrical body, said cylindrical body being fixed relative to said casing cover and having a pumping liquid inlet in the vicinity of an outlet for circulating high temperature pumping liquid formed on said submerged bearing, axially extending passages and a pumping liquid outlet provided radially inward of said pumping liquid inlet, said axially extending passages comprising a multiplicity of bores wherein said cylindrical body has a high strength, said multiplicity of bores being in parallel with each other, said pumping liquid flowing in a same direction along said bores, said cylindrical body being disposed inside of said journal of said submerged bearing, the high temperature pumping liquid being filled in a space confined by said heater and said journal and having a peripheral velocity component which causes a radial static differential pressure effecting circulation of the high temperature pumping liquid through said axially extending passages, said multiplicity of bores of said passages being provided in the vicinity of the inner periphery of said cylindrical body so that said low temperature seal purging liquid is heat-exchanged with said high temperature pumping liquid, said pumping liquid outlet of said cylindrical body being directed to an outwardly radial direction radially so that the pumping liquid therefrom is directed away from said pump shaft and remains substantially radial up to the confined space, and a temperature fluctuation adjacent to said pump shaft is minimized.

2. A thermal fatigue prevention apparatus for a high temperature pump, comprising:

an impeller in a high temperature pump casing, a pump shaft rotatably supported by a journal of a submerged bearing and projecting from a shaft through hole of a casing cover, a shaft sealing means provided between the pump shaft and the casing cover, said shaft sealing means being enclosed with a shaft sealing chamber which is supplied with a low temperature seal purging liquid for cooling and cleaning said shaft sealing means, said seal purging liquid flowing into said pump casing through said shaft through hole, and;

a heater provided within said high temperature pump, said heater raising the temperature of the low temperature seal purging liquid before said seal purging liquid flows into said pump casing by using a high temperature pumping liquid, said heater comprising a cylindrical body around said pump shaft, said seal purging liquid flowing through a cylindrical space formed between said pump shaft and said cylindrical body, said cylindrical body being fixed relative to said casing cover and having a pumping liquid inlet in the vicinity of an outlet for circulating high temperature pumping liquid formed on said submerged bearing, axially extending passages and a pumping liquid outlet provided radially inward of said pumping liquid inlet, said axially extending passages comprising a multiplicity of bores wherein said cylindrical body has a high strength, wherein said cylindrical body is disposed inside of said journal of said submerged bearing, the high temperature pumping liquid is filled in a space confined by said heater and said journal and has a peripheral velocity component which causes a radial static differential pressure effecting circulation of the high temperature pumping liquid through said axially extending passages, wherein a multiplicity of notches are formed on the end of said journal for enhancing said peripheral velocity component of said high temperature liquid, and wherein wedge-shaped notches are formed in a region of the pumping liquid inlet of the heater for damming the pumping liquid.

3. The thermal fatigue prevention apparatus of claim 2, wherein said pumping liquid outlet of said cylindrical body is directed to an outwardly radial direction so that the pumping liquid therefrom is directed away from said pump shaft and a temperature fluctuation adjacent to the pump shaft is minimized.

* * * * *